United States Patent [19]

Northrop et al.

[11] Patent Number: 4,891,550

[45] Date of Patent: Jan. 2, 1990

[54] PHOSPHOR BLEND FOR BROAD SPECTRUM FLUORESCENT LAMP

[75] Inventors: Donald Northrop, Glen Rock; Gerald Schiazzano, Livingston; Arpad Pirovic, Montvale, all of N.J.

[73] Assignee: Duro-Test Corporation, North Bergen, N.J.

[21] Appl. No.: 346,317

[22] Filed: May 1, 1989

Related U.S. Application Data

[63] Continuation of Ser. No. 108,895, Oct. 15, 1987, abandoned.

[51] Int. Cl.[4] ..... H01J 61/44

[52] U.S. Cl. ..... 313/487

[58] Field of Search ..... 313/485, 486, 487

[56] References Cited

U.S. PATENT DOCUMENTS 3,670,193 6/1972 Thorington et al. ..... 313/487

4,315,192 2/1982 Skwirut et al. ..... 313/487

*Primary Examiner*—Donald J. Yusko

*Assistant Examiner*—Sandra L. O'Shea

*Attorney, Agent, or Firm*—Darby & Darby

[57] ABSTRACT

A full spectrum fluorescent lamp having a phosphor coating for producing visible light having a high color rendering index and balanced amounts of ultraviolet energy at the same correlated color temperature in which the coating is formed of two groups of phosphors, the first producing the full spectrum when excited and the second narrow bands of visible light to improve the lumen output of the lamp.

17 Claims, 1 Drawing Sheet

PHOSPHOR BLEND FOR BROAD SPECTRUM FLUORESCENT LAMP

This is a continuation of application Ser. No. 108,895, filed Oct. 15, 1987, now abandoned.

BACKGROUND OF THE INVENTION

In prior U.S. Pat. No. 3,670,193, owned by the same assignee, a full spectrum lamp is disclosed which produces visible light at a given color temperature, 5500° K. in the preferred embodiment, and has a high C.I.E. color rendering index (CRI) typically greater than 80 and balanced amounts of near and mid ultraviolet energy (UVA and UVB) with the total spectral output correlated to that which is found in natural daylight of the same color temperature.

The present invention is directed toward an improved phosphor blend for a lamp of this general type for producing the broad spectrum visible light and ultraviolet energy output correlated to that of natural daylight at the same color temperature and which is capable of producing higher initial lumen output and has better maintenance in that more light is delivered over the life of the lamp. Accordingly, the lamp of the present invention is directed to more efficient light production in a full spectrum fluorescent lamp with essentially equal quality as compared to prior art lamps, i.e., more lumens per watt, with the quality of the light output being maintained over the life of the lamp due to a reduction in color shift of the light output.

BRIEF SUMMARY OF THE INVENTION

Accordingly, the present invention provides an improved phosphor blend for producing a full spectrum energy output with improved lumen output has two groups of phosphors. The first group comprises a blend, such as one of those disclosed in the aforesaid U.S. Pat. No. 3,670,193, which produces the full spectrum energy output, of visible and ultraviolet energy correlated to natural daylight at a given color temperature. The second group of phosphors is composed of a blend of mostly rare earth phosphors that produce primarily visible light output over narrow ranges of wavelengths and are considered more efficient and stable because of their crystal structure.

The two groups of phosphors can be deposited on the envelope of the lamp in one of either of two ways. The first is to mix the two groups together and lay them down as a single coat. The second is to use a two coat system in which the group for producing the full spectrum energy output is deposited on the inner wall of the envelope and the second group of the narrow band visible light emitting phosphors deposited thereover, closer to the arc stream discharge of the lamp. Depending upon the percentage of phosphors used for each group in the total blend of the two groups, the color rendering index (CRI) and the lumen output can be controlled, with the control depending upon the percentage of each phosphor group in the total blend. Basically, the greater the percentage of the first group the higher will be the CRI and the greater the percentage of the second group of narrow band phosphors, the higher will be the lumen output of the lamp.

As another feature of the invention, the lamp envelope is preferably made of a reduced diameter. Whereas conventional fluorescent lamp envelopes are of T12 diameters, (i.e., 12/8 inch diameter) the present invention preferably uses a T10 envelope (10/8 inch diameter). The use of the reduced diameter envelope permits more active and efficient interaction between the arc stream and the phosphors. This is advantageous since the narrow band phosphors of the second group, which are more expensive, are more efficiently excited when they are closer to the arc stream. Where the phosphor groups are deposited in two separate layers, since the narrow band phosphors are more resistant to deterioration by the intense arc stream the lamp maintenance is also improved.

OBJECTS OF THE INVENTION

It is therefore an object of the present invention is to provide an improved phosphor blend for fluorescent lamp capable of producing a full spectrum output.

Another object is to provide a phosphor blend for a fluorescent lamp comprised of two groups of phosphors, one group of phosphors for producing a desired full spectrum energy output at a desired color rendering index and the second group of phosphors being primarily those having narrow band outputs in the visible light range to enhance the lumen output of the lamp and the life of the composite blend.

An additional object is to provide a phosphor coating for a fluorescent lamp having a full spectrum output with higher initial lumens and better lumen maintenance.

Yet another object is to provide a phosphor coating for a fluorescent lamp which is laid down in a two coat system, the first coat having a group of phosphors contributing substantially to a full spectrum energy output having a high color rendering index and the second coat having a group of phosphors to contribute to increased lumen output in the visible light energy range.

An additional object is to provide a phosphor blend for a fluorescent lamp formed of two groups of phosphors, one for producing a full spectrum energy output with a high color rendering index correlated to natural daylight at a given color temperature and the second group of phosphors producing visible light over relatively narrow bands of energy, both groups balanced to the same color temperature with the two groups mixed and laid down in one coat or laid down in separate coats on the inner wall of an envelope of less than normal diameter (12/8 inches).

BRIEF DESCRIPTION OF THE DRAWINGS

Other objects and advantages of the present invention will become more apparent upon reference to the following specification and annexed drawings in which.

DETAILED DESCRIPTION OF THE INVENTION

Figure 1:
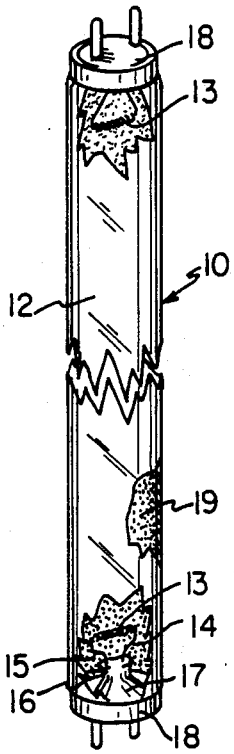
FIG. 1 is a perspective view of a typical fluorescent lamp utilizing the phosphor blend of the present invention.

FIG. 1 shows a representative fluorescent lamp 10 comprising an elongated envelope 12 of glass, such as soda-lime silicate glass, or envelope of other suitable glass, having a circular cross section. There is a low pressure mercury discharge assembly in the lamp including a conventional electrode structure 13 at each end connected to in-lead wires 14 and 15 which extend through a glass press seal 16 in a mount stem 17 to the electrical contacts of a base 18 fixed at both ends of the sealed glass envelope. The arc discharge-sustaining filling in the sealed glass envelope is an inert gas such as argon or a mixture of argon and other rare gases at a low pressure in combination with a small quantity of mercury to provide the low vapor pressure manner of lamp operation.

In a preferred embodiment of the invention, as described in the aforesaid U.S. Pat. No. 3,670,193, the glass of the envelope is preferably of the type which blocks the transmission of ultraviolet energy below the range of about 290 nm. Also, in accordance with the preferred embodiment of the invention, the envelope 12 is preferably of T10 size, rather than the more conventional T12 size, although the invention is applicable to all diameters of lamp envelopes.

The inner surface of the glass bulb has a phosphor coating 19 thereon, which is described in greater detail below.

Considering the phosphor coating 19, in the aforesaid U.S. Pat. No. 3,670,193 the various phosphor blends used to coat the lamp all have the capability of producing a full spectrum, i.e., a color rendering index in excess of 80, radiation in the near ultraviolet range, and radiation in the middle ultraviolet range, with the visible and ultraviolet radiation produced being transmitted through the lamp envelope in the quantities of between about 6–50 microwatts middle range ultraviolet radiation and between about 150–700 microwatts of near range ultraviolet radition per lumen of visible light with the radiant power ratio of near ultraviolet/middle ultraviolet radiation being in the range from between about 8 to 40. In the lamp of that patent the ultraviolet radiation transmitted through the envelope is of a total quantity substantially the same per lumen of visible light transmitted through the envelope as found in natural daylight of the same correlated color temperature.

In a preferred embodiment of lamps of the aforesaid patent, the correlated color temperature of the lamp was about 5500° K. Correlated color temperature is defined as the absolute temperature of a blackbody whose color nearly resembles that of the light source.

The phosphor blend of the lamp of the aforesaid patent was such that the C.I.E. color rendering index (CRI) of the lamp was greater than 80. As is known, the color rendering index of a fluorescent lamp is defined in Publication: CIE 13.2 Method of measuring and specifying color rendering properties of light sources. The industry generally uses only the first 8 color chips in determining the CRI.

The present invention provides improvements in the phosphor coatings for lamps of the type of the aforesaid patent from the point of view of providing higher initial lumen output and better light maintenance. The phosphor blends of the present invention improve light maintenance and deliver more visible light (measured in lumens) over the life of the lamp; there is more efficient production of visible light with essentially equal quality, i.e., there are more lumens per watt meaning increased efficiency of the lamp; and there is reduced color shift during the life of the lamp. All of this is within the context of a blend which produces a full spectrum. This color shift is reduced, in accordance with the subject lamp in approximate proportion of the increased amount of total light from the narrow band phosphors.

In accordance with the invention the phosphor blend is formed of two different phosphor groups. The first group is a mixture of three or four or more phosphors which is used to produce the desired full spectrum energy output having the high color rendering index and the balanced amounts of UVA and UVB, as discussed in the aforesaid U.S. Pat. No. 3,670,193 and as previously referred to. That patent discloses several blends which can be used to achieve this result and any of such blends, as well as others, are useable in the subject lamp. The phosphors of this blend are generally wide band in visible light energy output. That is, they produce visible light over bands typically from about 70 nm to even out 200 nm wide. One or more of the phosphors and the mercury line spectrum from the arc discharge produce the desired amounts of UVA and UVB energy so that the complete spectrum satisfies the full spectrum requirement.

To better describe the invention and to illustrate its advantages, a phosphor blend similar to one described in the aforesaid patent is used. It has the following phosphors in the weight ratios given. The blend is:

TABLE 1

| | (GROUP 1 BLEND) |
|---|---|
| 63.3% | A. Strontonium Magnesium Orthophosphate:Tin |
| 25.8% | B. Magnesium Tungstate: Tungstan |
| 3.9% | C. Zinc Orthosilicate: Maganese |
| 7.0% | D. Barium Mesosilicate: Lead (Similar to formula in patent, page 11 |

The above group of phosphors is basically blended to achieve full spectrum output (visible light and ultraviolet as defined above) from a fluorescent lamp at a color temperature of about 5500K°. The color temperature can be raised by using more or less of the phosphors which produced different colors of the visible spectrum.

The second group of phosphors is composed primarily of rare earth phosphors that are considered more efficient and stable. These phosphors typically have very narrow band widths, e.g., from about 5 nm to about 60 nm, in the visible light range. The phosphors in the second blend group are blended in a ratio to approximately achieve the same color temperature as the first blend. For a 5500° K. phosphor blend, the following can be used:

TABLE 2

| | (GROUP 2 BLEND) |
|---|---|
| 40.3 | E. Yttrium Oxide: Europium |
| 16.7 | F. Strontium Calcium Barium Chlorophosphate: Europium |
| 35.0 | G. Magnesium Aluminate: Cerium Terbium |
| 8.0 | H. Cerium Magnesium Barium Aluminate: Cerium |

The above narrow band phosphors have the following spectral characteristics.

| Phosphor | Color | Wavelength at Peak | CIE Color Coordinates x | y | APPROX. Bandwidth |
|---|---|---|---|---|---|
| E. | Red | 611 nm | 0.641 | 0.349 | 10 nm |
| F. | Blue | 453 nm | 0.151 | 0.640 | 60 nm |
| G. | Green | 541 nm | 0.323 | 0.609 | 30 nm |
| H. | Black Light | 344 nm | — | — | 40 nm |

As seen, phosphor H. of the second group does not produce visible light. It contributes to the ultraviolet energy part of the spectral power output. However, it is a rare earth phosphor which is stable and therefore also enhances the overall maintenance of the lamp.

Both phosphor groups preferably should radiate the same color temperature visible light to minimize the effects of any color shift during lamp life due to the degradation rate of the various phosphor components.

Depending upon the relative proportions of the two blends in the composite, there will be changes in the color rendering index and the lumen output of the visible light. Basically, as the weight proportion of the second group of phosphors is increased as a percentage of the total weight of the two groups of phosphors, the lamp lumens and maintenance increases while CRI decreases. The ranges of lumen maintenance and CRI are set by the percentage of the phosphors selected for each group.

Figure 2:
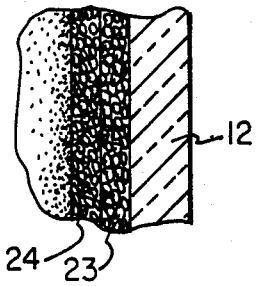
FIG. 2 is a fragmentary view of the lamp envelope of FIG. 1 showing the phosphor blend laid down in two separate coats.

In a preferred embodiment of the present invention, the two phosphor group blends are applied to the inner face of the lamp envelope in a two coat system. That is, in a typical process, each of the blends of Group 1 and Group 2 are separately mixed. Thereafter, the lamp envelope is first coated with the Group 1 blend, dried and baked in the conventional manner. After this is completed, the Group 2 phosphor blend is applied to the interior of the lamp envelope over the already deposited and adhered phosphor blend 1. FIG. 2 shows a fragment of the lamp envelope 12 with the Group 1 blend 23 shown being on the envelope wall and the Group 2 blend 24 laid down over the Group 1 blend and being closer to the arc stream discharge.

The results of lumen output and CRI using 100% of either the Group 1 and Group 2 blend as a single layer on a fluorescent lamp envelope are shown below, for 40 T12 lamps:

| | Lumens | CRI |
|---|---|---|
| 100% layer Group 1 blend | 2180 | 91 |
| 100% layer Group 2 blend | 3080 | 78 |

As can be seen, the Group 1 blend when used along has higher CRI and lower lumen output than the Group 2 blend, and vice versa.

Table 3 below shows the effect of varying the percentages of the Group 1 and Group 2 blends over the complete range of 0%–100% in a two coat system. That is, going from left to right on Table 3, the amount of Group 1 blend (the blend for producing the balanced spectrum) decreases while that of the Group 2 blend increases. The bottom two lines in the chart show the result of total lumen output and color rendering index. Here the results are given for a 40T10 lamp. The letters identify the individual phosphors from Tables 1 and 2.

TABLE 3

(Weight ratios of the combined phosphor of Tables 1 and 2 for two coat application showing approximate lumen and CRI lamp output (40 T10)).

| % of Group 1 | 100% | 35% | 30% | 25% | 20% | 15% | 0 |
|---|---|---|---|---|---|---|---|
| % of Group 2 phosphor | 0 | 65 | 70 | 75 | 80 | 85 | 100% |
| | | | GROUP 1 | | | | |
| A. | 63.3 | 22.2 | 19.0 | 15.8 | 12.6 | 9.5 | — |
| B. | 25.8 | 9.0 | 7.7 | 6.5 | 5.2 | 3.9 | — |
| C. | 3.9 | 1.4 | 1.2 | 1.0 | 0.8 | 0.6 | — |
| D. | 8.0 | 2.4 | 2.1 | 1.7 | 1.4 | 1.0 | — |
| | | | GROUP 2 | | | | |
| E. | — | 26.2 | 28.2 | 30.2 | 32.2 | 34.3 | 40.3 |
| F. | — | 10.9 | 11.7 | 12.5 | 13.4 | 14.2 | 16.7 |
| G. | — | 22.7 | 24.5 | 26.3 | 28.0 | 29.7 | 35.0 |
| H. | — | 5.2 | 5.6 | 6.0 | 6.4 | 6.8 | 8.0 |
| Lumens | 2180 | 2660 | 2760 | 2800 | 2850 | 2910 | 3080 |
| CRI | 91 | 82 | 81 | 80 | 70 | 79 | 78 |

As can be seen, as the percentage of the Group 1 blend decreases and that of the Group 2 blend increases in the two coat system, the CRI decreases and the lumen output increases. Conversely, as the Group 1 blend increases as a percentage of the total weight, the CRI increases and the lumen output decreases.

The two groups of phosphors forming the two blends can initially be mixed in one suspension and laid down as a single coat on the wall of the lamp envelope. The advantage of this is that only one coating application, drying and baking of the coating is needed, this being similar to conventional lamp making. The difference is an increase in phosphor costs over the two coat system described above. The reason for the difference in cost is that the phosphors used in the Group 2 blend are more expensive than those used in the Group 1 blend.

When the Group 2 blend is used as the inner coat of the two coat system, the phosphors are more highly activated since they are closer to the arc stream. When the phosphors of the Group 2 blend are mixed with the less expensive phosphors of the Group 1 blend, they become uniformly dispersed in the final composite blend. Since they are less not exposed directly to the arc stream, and the activation of phosphors decreases rapidly through the coating, the Group 2 phosphors are not as actively excited as they are when forming the inner coat of a two coat system. For this reason, more of the more expensive Group 2 phosphors must be used than in the two coat system. Thus, while the percentages of Group 1 and 2 phosphors could be the same in the one and two coat systems, there will be more phosphor of both groups by weight for the reasons given.

Since it is desired to more highly activate the phosphors of the Group 2 blend, then the use of the smaller diameter T10 envelope aids in achieving this goal. That is, since the envelope diameter is smaller than usual, there is a higher degree of activation of the phosphors which is more important as to those of the Group 2 blend. The use of the smaller diameter envelope is advantageous in both one and two coat systems since in each case the narrow band group 2 phosphors are closer to the arc stream.

Figure 3:
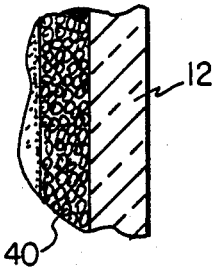
FIG. 3 is a fragmentary view of the lamp envelope of FIG. 1 showing the phosphor blend laid down in a single coat.
Figure 4:
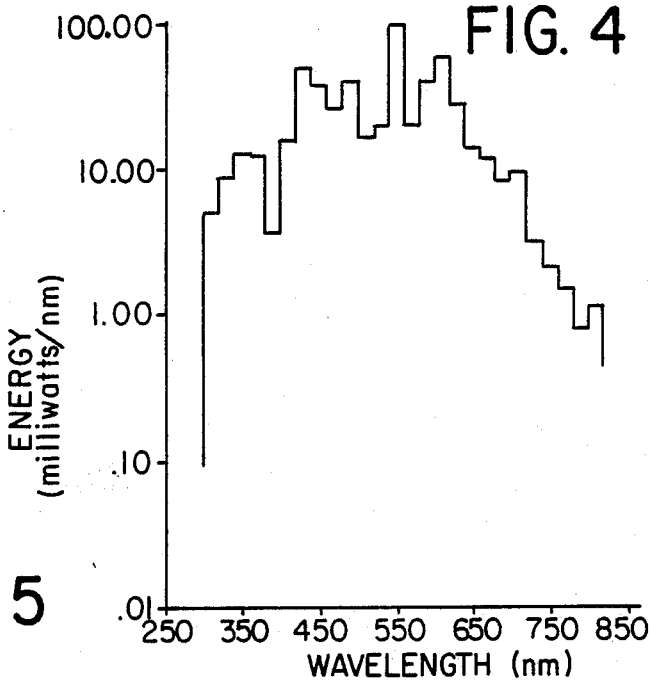
FIG. 4 is a diagram showing the spectral power distribution of a phosphor blend in accordance with the invention.
Figure 5:
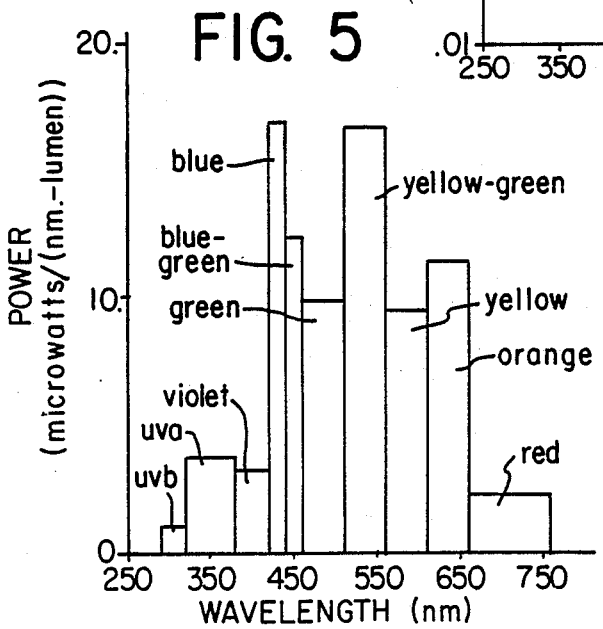
FIG. 5 is a diagram showing the spectral power distribution in terms of bands related to the color and ultraviolet energy.

For example, referring to Table 3 above, to achieve a coating having a light output at a color temperature 5500° K. with a CRI of at least 80, about 25% by weight of the phosphors of blend 1 and 75% by weight of the phosphors of blend 2 are combined into one suspension and applied as a single coating. FIG. 3 shows a fragment of a lamp envelope on which the mixture of the Group 1 and 2 phosphor blends has been deposited as a single coating layer 40. FIG. 4 shows the spectral power distribution of this blend when used in a T10 envelope, 4 feet long. The segments of the graph of FIG. 4 are approximately 20 nm wide. FIG. 5 shows the spectral power distribution from another point of view in that these are a number of wide bandwidth segments corresponding to different colors and ultraviolet energy.

A similar range of lumens and CRI with the same boundaries can be developed for the one coat system as in the case for the two coat system. The choice as to which system to use is one of economic decision. As previously explained, the two coat system requires additional capital expenditures in that two drying and baking systems are needed but has lower material costs, i.e., less of the more expensive Group 2 phosphors are used. The one coat system is simpler more conventional to produce but with higher material costs.

Table 4 shows a blend for one coat system using an alternate blend of phosphors which produce higher CRI's for similar lumen values of blends of groups 1 and 2 phosphors.

TABLE 4

| % of Blend | Phosphor |
|---|---|
| 1.8 | I. Calcium Halophosphate: Tin and Manganese |
| 0.5 | J. Zinc Orthosilicate: Manganese |
| 20.7 | K. Strontium Magnesium Orthophosphate: Tin |
| 23.0 | L. Strontium Borophosphate: Europium |
| 19.8 | E. Yttrim Oxide: Europium |
| 7.7 | F. Strontium Calcium Barium Chlorophosphate: Europium |
| 15.2 | G. Lanthanum Phosphate: Cerium and Terbium |
| 3.3 | H. Cerium Magnesium Barium Aluminate: Cerium |
| 8.0 | M. Barium Mesosilicate: |

Phosphor M. is added to produce the balanced UV energy.

In this blend, phosphor L. strontium borophosphate: Europium is a rare earth phosphor which would more typically be of the Group 2 type. However, it has a relatively wide band, of about 50 nm, in the blue-green range and is useful for increasing the CRI.

What is claimed is:

1. A fluorescent lamp for general illumination purposes operable from a source of voltage comprising an envelope capable of transmitting light in the visible, and middle and near ultraviolet ranges, a pair of electrodes for connection to said voltage source and an ionizable medium upon operation of the lamp producing an electrical arc stream discharge, first and second phosphor blend groups on the wall of said envelope, the phosphors of said first group excited by the radiant power of the electrical discharge for producing radiation having a spectrum in the visible light range with a C.I.E. color rendering index of at least 80, radiation in the near ultraviolet range, and radiation in the middle ultraviolet range, said visible and said ultraviolet radiation produced being transmitted through said envelope in the quantities of between about 6–50 microwatts of middle range ultraviolet radiation and between about 150–700 microwatts of near range ultraviolet radiation per lumen of visible light with the radiant power ratio of near ultraviolet/middle ultraviolet radiation being in the range from between 8 to 40, said ultraviolet radiation transmitted through said envelope being of a total quantity substantially the same per lumen of visible light transmitted through said envelope as found in natural daylight of the same correlated color temperature, phosphors of said second group when excited by said electrical discharge producing at least narrow bands of visible radiant energy in the range of from about 5 nm to about 60 nm for increasing the lumens per watt output of visible light from the lamp.

2. A fluorescent lamp as in claim 1 wherein the first group of phosphors are excited by the radiant power of the electrical discharge to produce respective quantities of radiation transmitted through said envelope in each of said middle and near ultraviolet ranges per lumen of visible light which are substantially the same as that found in the corresponding ranges of natural daylight for the same correlated color temperature.

3. A fluorescent lamp as in claim 1 wherein the color temperature of the visible light energy produced by said first and second groups of phosphors is substantially the same.

4. A fluorescent lamp as in claim 3 wherein said color temperature is substantially about 5500° K.

5. A fluorescent lamp as in claim 1 wherein said phosphors of said first and second groups are formed together in a single mix which is laid down on the envelope wall.

6. A fluorescent lamp as in claim 1 wherein the phosphors of said two blends are laid down in two separate coats with the first coat formed by the phosphor of said first group laid down on the envelope wall and the narrow band phosphors of said second group forming the second coat laid down over said first coat and closer to the electrical arc stream discharge.

7. A fluorescent lamp as in claim 1 wherein the narrow band phosphors of said second blend are rare earth phosphors.

8. A fluorescent lamp as in claim 1 wherein the phosphors of said second blend produces visible light in respective bands of wavelengths in the range of from about substantially 5 nm to greater than substantially about 60 nm wide within the visible light range.

9. A fluorescent lamp as in claim 1 wherein the phosphors of said first blend comprise substantially

| % of Blend | Phosphor |
|---|---|
| 63.3% | Strontonium Magnesium Orthophosphate:Tin |
| 25.8% | Magnesium Tungstate: Tungsten |
| 3.9% | Zinc Orthosilicate: Maganese |
| 7.0% | Barium Mesosilicate: Lead (Similar to formula in patent, page 11 |

10. A fluorescent lamp as in claim 1 wherein the phosphors of said second blend comprise substantially:

| % of Blend | Phosphor |
|---|---|
| 40.3 | Yttrium Oxide: Europium |
| 16.7 | Strontium Calcium Barium Chlorophosphate Europium |
| 35.0 | Lanthanum Phosphate: Cerium & Terbium |
| 8.0 | Cerium Magnesium Barium Aluminate: Cerium |

11. A fluorescent lamp as in claim 7 wherein one of the phosphors of said second blend produces energy in the ultraviolet range.

12. A fluorescent lamp as in claim 5 wherein the phosphor mix comprises substantially:

TABLE 4

| % of Blend | | Phosphor |
|---|---|---|
| 2.0 | [I.] | Calcium Halophosphate: Tin and Manganese |
| 0.5 | [J.] | Zinc Orthosilicate: Manganese |
| 22.5 | [K.] | Strontium Magnesium Orthophosphate: Tin |
| 25.0 | [L.] | Strontium Borophosphate: Europium |
| 21.5 | [E.] | Yttrim Oxide: Europium |
| 8.4 | [F.] | Strontium Calcium Barium Chlorophosphate: Europium |
| 16.5 | [G.] | Lanthanum Phosphate: Cerium and Terbium |
| 3.6 | [H.] | Cerium Magnesium Barium Aluminate: Cerium |
| 8.0 . . . | 8% | Barium Mesosilicate: Lead [is.] |

13. A fluorescent lamp for general illumination purposes operable from a source of voltage comprising an envelope capable of transmitting light in the visible, and middle and near ultraviolet ranges, a pair of electrodes for connection to said voltage source and an ionizable medium within said envelop, said electrodes and said ionizable medium upon operation of the lamp producing an electric arm stream discharge a first phosphor blend group of relatively wide band phosphors, each of whose visible light components are in the range of from about 70 nm to about 200 nm wide selected such as when excited by the radiant power of the electrical discharge for producing radiation having a spectrum in the visible light range with a C.I.E. color rendering index of at least 80, radiation in the near ultraviolet range, and radiation in the middle ultraviolet range, said visible and said ultraviolet radiation produced being transmitted through said envelope in the quantities of between about 6–50 microwatts of middle range ultraviolet radiation and between about 150–700 microwatts of near range ultraviolet radiation per lumen of visible light with the radiant power ratio of near ultraviolet/-middle ultraviolet radiation being in the range from between about 8 to 40, said ultraviolet radiation transmitted through said envelope being of a total quantity substantially the same per lumen of visible light transmitted through said envelope as found in natural daylight of the same correlated color temperature, and a second blend of a group of phosphors producing visible light in various narrow band ranges of from about 5 nm to about 60 nm when excited by the electrical discharge, the amount of the phosphors of said second group of phosphors relative to the phosphors of said first group for increasing the lumens per watt output of visible light from the lamp while decreasing the color rendering index.

14. A fluorescent lamp as in claim 1 wherein said second group of phosphors contain at least one rare earth phosphor for producing ultraviolet energy.

15. A florescent lamp as set forth in claim 1 wherein said envelope has a T 10 diameter.

16. A florescent lamp as set forth in claim 5 wherein said envelope has a T 10 diameter.

17. A florescent lamp as set forth in claim 6 wherein said envelope has a T 10 diameter.

* * * * *